United States Patent [19]

Fackler

[11] 4,418,351

[45] Nov. 29, 1983

[54] ANTENNA SYSTEM WITH DIRECTIONAL SWITCHING MEANS

[76] Inventor: John D. Fackler, 172 Center St., Southport, Conn. 06490

[21] Appl. No.: 253,658

[22] Filed: Apr. 13, 1981

[51] Int. Cl.[3] ..... H01Q 21/26

[52] U.S. Cl. ..... 343/797; 343/876; 358/83

[58] Field of Search ..... 343/720, 797, 799, 876, 343/100 AD, 797; 358/83, 93

[56] References Cited

U.S. PATENT DOCUMENTS

| | | | |
|---|---|---|---|
| 3,095,538 | 6/1963 | Silberstein | 343/876 |
| 3,984,625 | 10/1976 | Camras | 358/83 |
| 3,996,592 | 12/1976 | Kline et al. | 343/876 |

*Primary Examiner*—David K. Moore

*Attorney, Agent, or Firm*—Robert H. Montgomery

[57] ABSTRACT

An antenna system comprising a plurality of angularly disposed antennae which are selectively actuated to transmit dependent on the directional orientation of the transmitter with respect to a receiving station.

26 Claims, 14 Drawing Figures

ANTENNA SYSTEM WITH DIRECTIONAL SWITCHING MEANS

FIELD OF THE INVENTION

This invention relates to antenna systems and more particularly relates to an antenna system where one of a plurality of equiangularly displaced antennae is actuated to transmit a signal from a portable transmitter to a given direction regardless of the orientation of the direction of the transmitter which the antennae serve.

BACKGROUND OF THE INVENTION

Many activities are video photographed by portable shoulder and/or hand-carried cameras, together with a video transmitter which transmits to a master or relay station for retransmittal. Such activities may include golf tournaments, political conventions and live news coverage of various events and activities.

The transmitting power of such portable video cameras and transmitters is limited. Also the microwave transmission of the video signals is quite directional. The cameramen may be photographing at any degree of the compass. Depending upon the environment, direct transmission from the video camera transmitter to the master or relay station may, in some circumstances, be blocked and the cameraman has to seek a different angle, or the cameraman may have no control over the direction in which he is photographing a subject or an object.

Accordingly, the present invention provides an antenna system which includes a plurality of equiangular positioned antennae, each adapted to selectively serve the video transmitter to transmit a signal toward a predetermined location regardless of the direction in which the video cameraman is photographing.

SUMMARY OF THE INVENTION

The invention comprises antennae which are equally angularly directed about a polygonal and where one antenna is selectively actuated to transmit, dependent upon an orientation of the antennae and transmitting system. Each antenna will cover a predetermined angular portion of the compass, or 360 degrees, and only one antenna is selectively energized depending upon the position of the transmitter with respect to the master or relay station.

The system is initially oriented by a direction indicating means, which may be in the form of a compass. The direction means tracks the direction in which the video camera is oriented. A plurality of sensing means corresponding to the number of antennae are angularly disposed in respect to the direction indicating means to sense an indicated direction within a predetermined angle of the compass, or 360 degrees.

Logic means are provided which initially orient the system to a line of sight within a predetermined angle, between the video transmitter and a master or relay station. Thereafter the initial orientation, the logic means, in accordance with the direction indicating means and the sensing means will selectively actuate an antenna which will radiate the transmitter signal toward the master or relay station.

The direction indicating means may comprise a compass having a compass disc with an arcuate slot therein which, dependent upon the direction of the video camera, will enable a sensing means to determine the angular sector and therefore the antenna from which the video signal will be transmitted. If the antennae are four in number, four sensing means will be provided 90 degrees apart with an arcuate slot of approximately 85 degrees in a compass disc. If six antennae are utilized, there will be six sensing means, each covering a 60 degree sector of the compass and the arcuate slot in the compass disc may be on the order of 55 to 57 degrees.

The sensing means comprises infra-red emitters equally angularly displaced around the compass and a similar number of photosensitive devices adapted to be energized from the emitters when uncovered by the arcuate slot in the compass disc.

The direction indicating device may include a directional gyro rather than a compass disc.

The features of the invention which are believed to be novel are particularly pointed out and distinctly claimed in the concluding portion of this specification.

The invention, however, both as to its operation and organization, together with objects and advantages thereof, may best be appreciated by reference to the following detailed description taken in conjunction with the drawings.

OBJECTS OF THE INVENTION

An object of this invention is to provide a new and improved antennae system which is always oriented to transmit toward a predetermined location regardless of the directional orientation of the transmitter.

Another object of this invention is to provide a new and improved antenna system having a plurality of equiangularly spaced antenna where one antenna is selected to transmit in accordance with a direction sensing means.

A further object of this invention is to provide an antenna system for a video camera transmitter which will always transmit toward a predetermined location.

DESCRIPTION OF A PREFERRED EMBODIMENT

Figure 1:
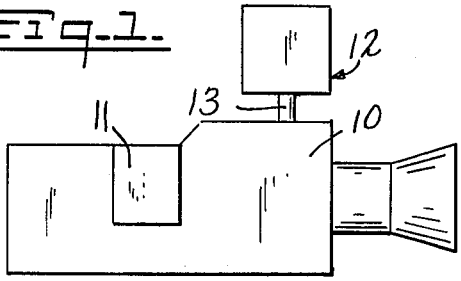
FIG. 1 is a side elevation representation of a video camera with an antenna system embodying the invention.

FIG. 1 illustrates a portable video camera 10, having a transmitter 11, as disclosed in application Ser. No. 219,602, filed Dec. 24, 1980 thereon. Operatively coupled to transmitter 11 is an antenna housing 12 as hereinafter described.

Antenna housing 12 is mounted to camera 10 by means of a support shaft 13. The support shaft 13 is mounted to housing 12 by means of a bracket 14 on bottom wall 15.

Housing 12 is polygonal in configuration and as shown has side walls 16, 17, 18, and 19, and a top wall 20. Housing 12 is in fixed relation to the camera.

Defined on each of side walls 16–19 is an antenna as hereinafter described.

Figure 6:
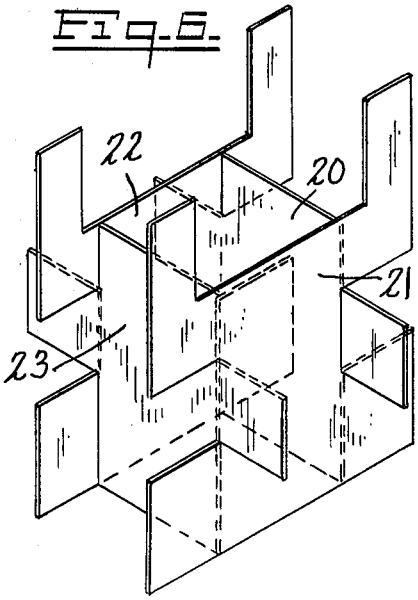
FIG. 6 is a isometric view of reflectors within the housing of FIG. 1.

Disposed within housing 12 are a plurality of reflector elements 20–23 (FIG. 6) which also rigidize housing 12.

Reflectors 20–23 define a recess which accepts a directional finding means in the form of a compass 24.

Figure 4:
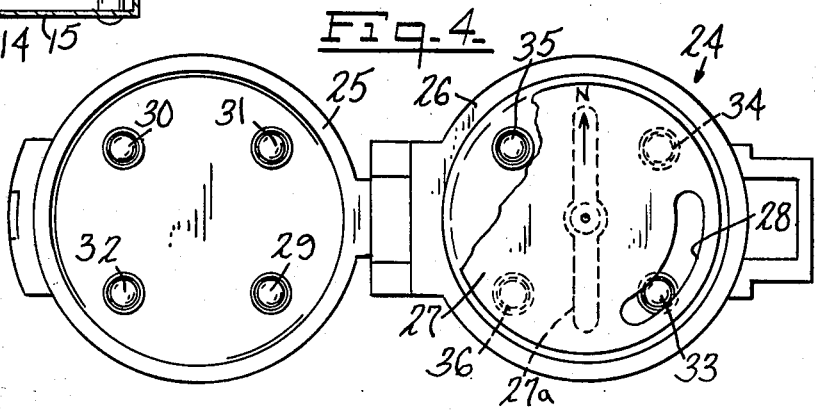
FIG. 4 is a plan view of a hinged compass which may be utilized in the invention.
Figure 5:
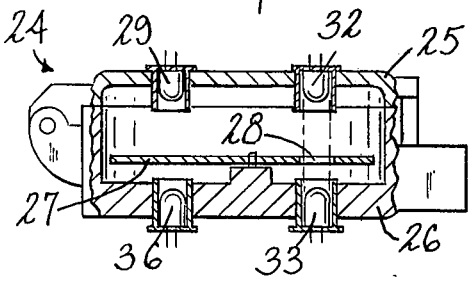
FIG. 5 is a half-sectional view of the compass of FIG. 3 in an operative position.

Compass 24, as shown modified from a commercial element, comprises an upper housing member 25 and a lower housing member 26. A magnetic compass disc 27 carrying a bar compass 27*a* is pivotally mounted to lower housing member. Disc 27 has an arcuate slot 28 defined therein. Equiangularly disposed on upper housing member 25 are a plurality of light emitters 29–32. A corresponding plurality of light responsive receivers 33–36 are carried on lower housing member 26. The light emitters 29–32 and receivers 33–36 are aligned so that one emitter may energize a corresponding receiver when slot 28 permits light communication. As shown in FIGS. 4 and 5, slot 28 permits light communication between emitter 31 and receiver 33. Communication between an emitter and a receiver may vary dependent on the directional orientation of camera 10 and antenna housing 12 therewith.

As hereinafter described, one of the antenna on a side wall of housing 12 may be selectively energized in accordance with the directional orientation of compass disc 28. Disc 28 has affixed thereto a polarized magnet 27*a* which determines the orientation of disc 27. Slot 28 is slightly less in angular extent than the angle between an emitter. In the embodiment shown where corresponding emitters and receivers are angularly spaced ninety degrees, the slot 28 may span approximately eighty-five degrees to ensure that only one emitter and one receiver are in registry at one time.

A connector 38 for a cable (not shown) is provided on housing 12 for communication between transmitter 11 and the antennae as hereinafter described.

Light communication between aligned pairs of emitters 29, 30, 31, and 32 and receivers 33, 34, 35, and 36 respectively, is achieved through slot 28 dependent upon directional orientation of the camera and the antenna assembly bearing the directional means in fixed relation thereto.

Figure 7:
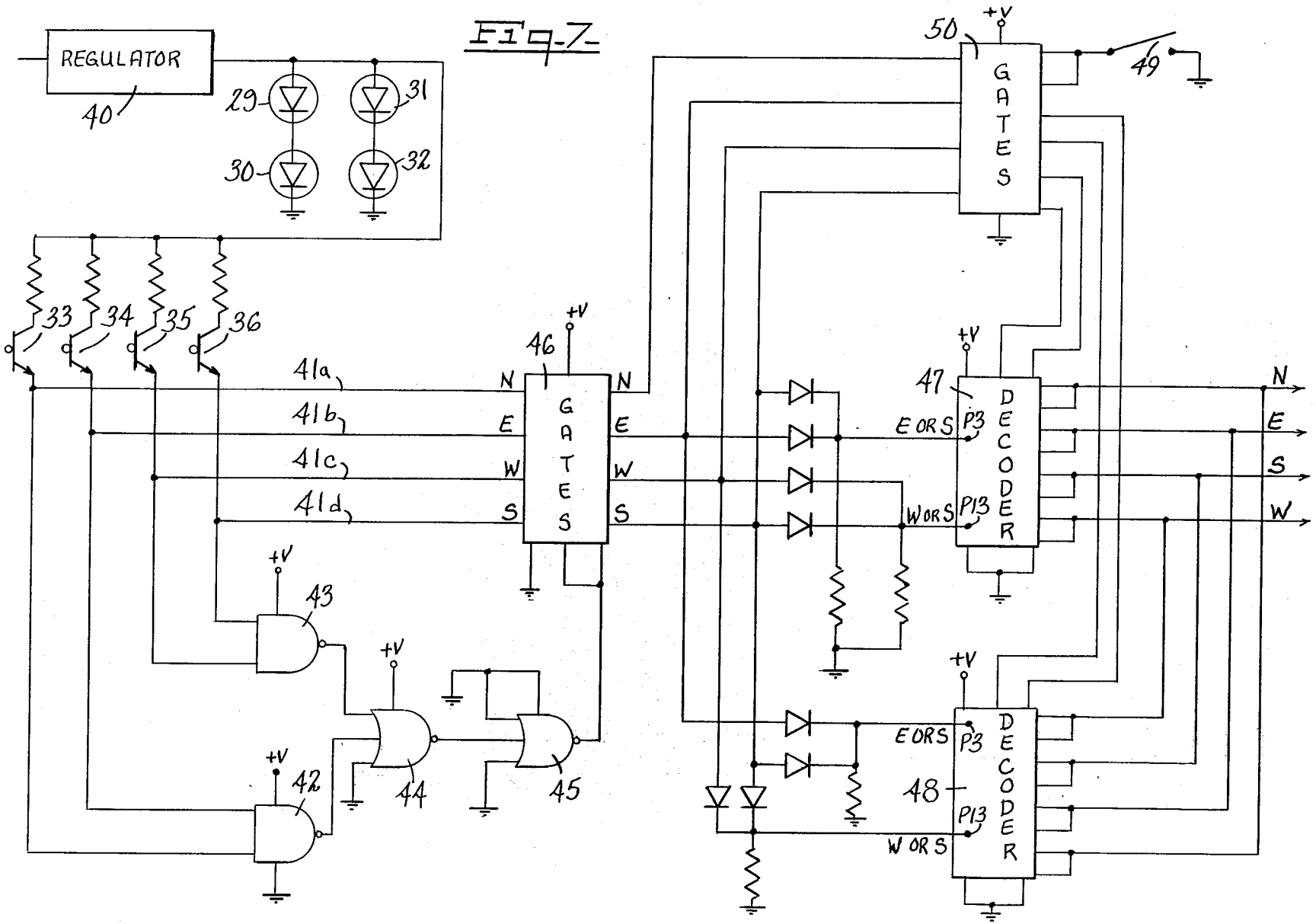
FIG. 7 is a diagram, partly schematic and partly in block form, of a logic network for selecting an antenna.

A directional logic network is provided as shown in FIG. 7.

Voltage is applied from a battery pack (not shown) through a regulator 40 to the four emitters 29–32 which may be of the infra-red type. The receivers 33–36 may be phototransistors. Outputs of the receiver-transistors 33–36 are applied to lines 41*a*–41*d*, respectively, and then applied to a master four-gate network 46 which is preferably an integrated chip 74LS75, hereinafter more fully described. The outputs of the transistors 33 and 34 are applied to a Nand circuit 42. The outputs of transistors 35 and 36 are applied to a Nand circuit 43. If no signal is applied to gate 43, there will be an output to an exclusive or circuit 44. The same is true with gate 42, thus exclusive or circuit 44 will only pass a signal to a driver 45 when there is a signal output from only one of transistors 33–36. Driver 45 will then apply an enabling signal to gates 46. For purposes of explanation only, lines 41*a*–41*d* will be labeled in N, E, S and W for the directions North, East, South and West. Symbols will hereinafter be utilized merely to show four quadrants. These symbols will also be utilized for tracking the respective quadrant signals through other logic elements.

The outputs of gate 46 are applied to two-to-four bit decoders 47 and 48. The W or E signals are applied to a input P3 of decoder 47 and the S or W signals are applied to input P13 of decoder 57. The S or W signal is also applied to input P13 of decoder 48 and the E or S signal is connected to input P3 of gate 48. The output of gates 46 are applied to another latching or gating circuit 50.

The system is initially oriented as to an antenna port on housing 12 by the cameraman pointing his camera with one port of the antenna at a receiving or relay station. This may be done by aiming the camera at the receiver. Then the cameraman closes switch 49 to apply an enabling signal to the latches 50. This initially orients the system and W, S, or E signal will be applied to one of decoders 47 and 48.

The logic of the system is as follows: If there is an S output from gate 46, there will be an S output from gate 50 to decoder 48. When this coincides with an S input to decoder 48 from a gate 46 there is a S output from decoder 48. If there is a W output from gate 50 and a W input to decoder 48 there will be a W output from decoder 48.

If there is an N input to decoder 57 and no signal to inputs P3 and/or P13 then there will be an N output from decoder 47.

If there is an E input to decoder 47 from gate 46 and gate 50 where will be an E output from decoder 47.

Figure 8:
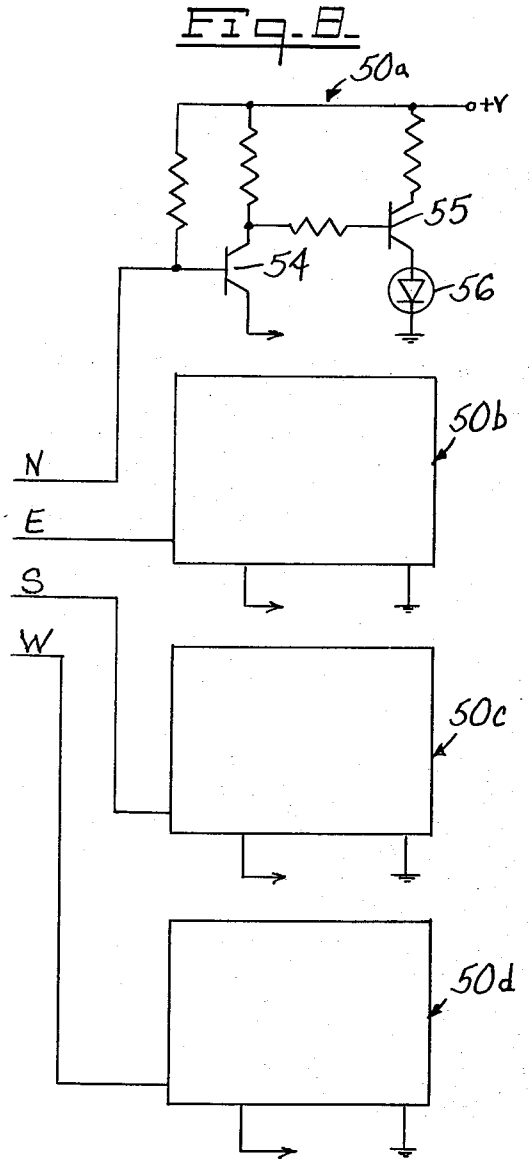
FIG. 8 is a continuation of FIG. 7.

Each of the N, E, S, and W signals applied to an antenna selector network 50*a*, 50*b*, 50*c*, or 50*d* (FIG. 8) will select one of the antennae on housing 12 for transmission. Each of the antenna selector circuits comprises a first transistor 54 which is normally conducting, but when it receives a N, E, W, or S signal turns off. At this point another transistor 55 will conduct and illuminate a light-emitting diode 56 which will indicate which antenna is transmitting. The transistors 54 associated with the three unused antennae will remain conductive and short out the non-selected antennae.

Figure 9:
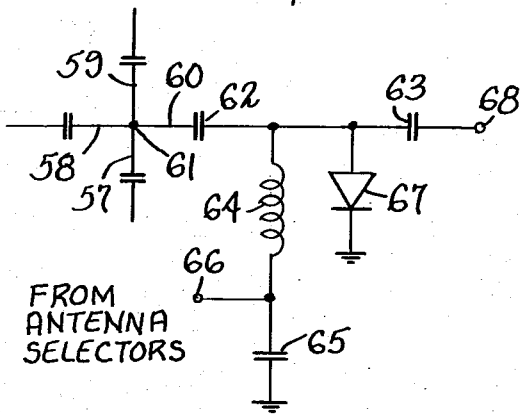
FIG. 9 is an antenna switching network.

An antenna switching circuit is shown in FIG. 9 and comprises four legs 57, 58, 59 and 60 (only leg 60 is shown in detail). Each leg is connected to a common input terminal 61 which receives a signal from transmitter 11. Each antenna switching leg includes capacitances 62 and 63, and a decoupling choke 64 in series with a capacitor 65. The input from a transistor 54 in a selection network (50*a*–50*d*) is applied to a terminal 66 between choke 64 and capacitance 65. If the associated transistor 54 (FIG. 8) is conducting, a diode 67 will conduct and ground the antenna switching leg. Diodes 67 are one-quarter wavelength from the radio frequency input terminal 61. The other switching legs 57–59 are the same as leg 60.

All antenna switching legs are shorted except the one which connects the transmitter to the transmitting antenna.

Figure 2:
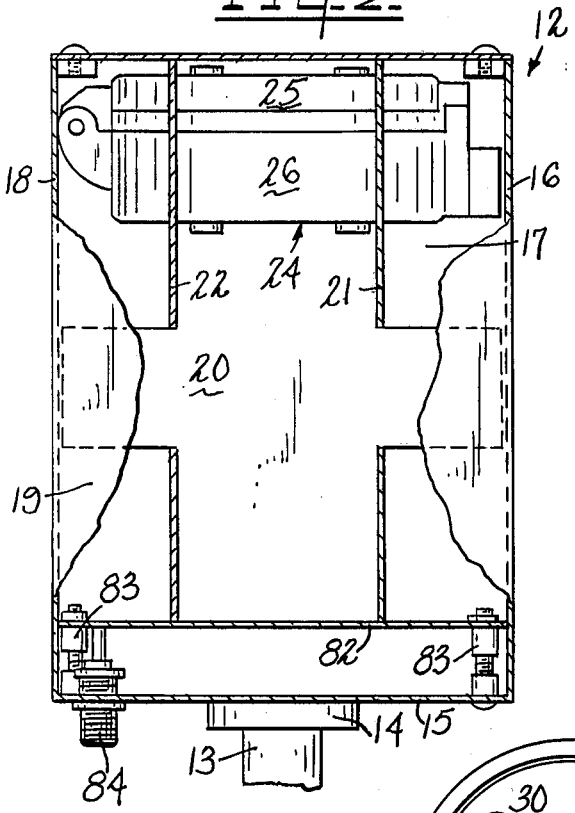
FIG. 2 is a side elevation, partially cut away, of an antenna housing embodying the invention.
Figure 3:
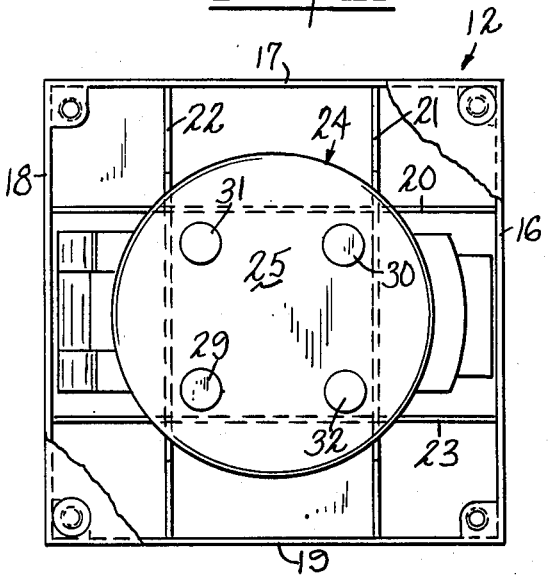
FIG. 3 is a plan view, partially cut away, of the housing of FIG. 1.
Figure 10:
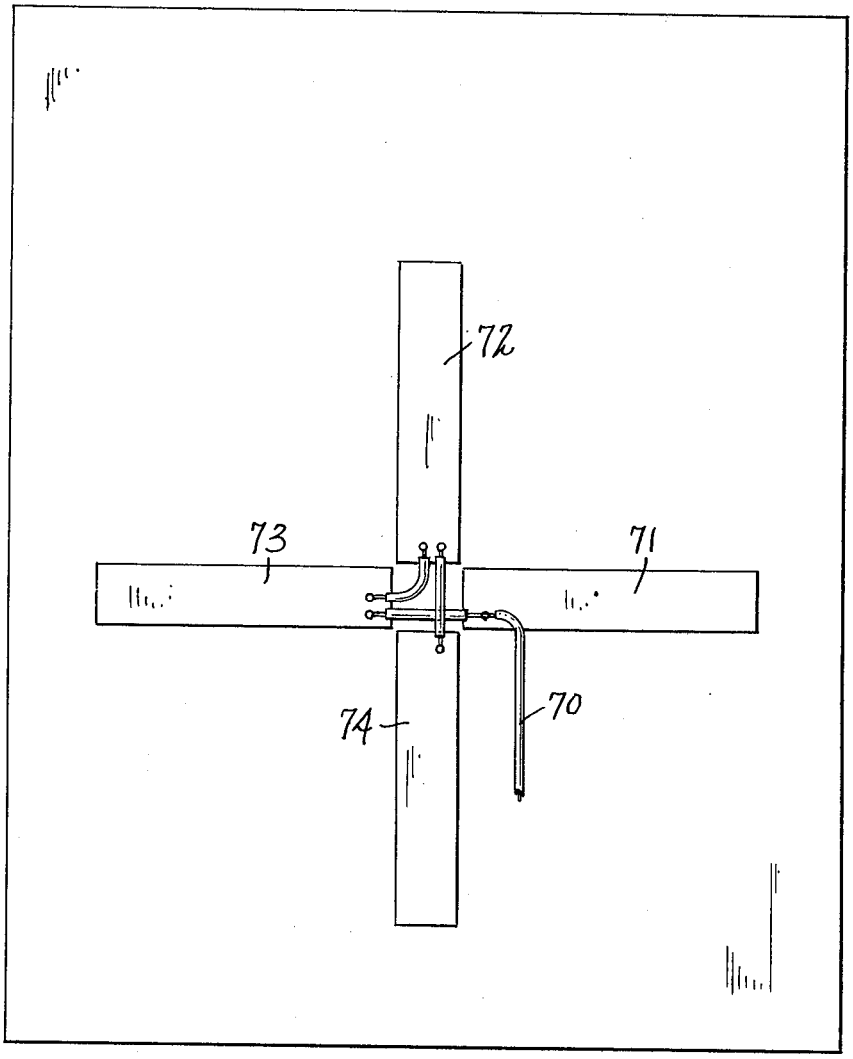
FIG. 10 is a diagram of an antenna on one side wall of housing 12.

The antennae are defined on the inside of each of housing walls 16–19 (FIGS. 2 and 3), hereinafter referred to as ports. Each antenna (FIG. 10) is connected to terminal 68 of one of legs 57–60 by a cable 70. Each antenna comprises four strips of metal 71–74 coated or printed on the inside of the housing walls 16–19. The walls 16–19 may be made of fiberglass reinforced "Teflon". The strips 71–74 are connected as dipoles as shown. Each antenna pattern is rotated forty-five degrees on adjacent walls. Each antenna may transmit a circularly polarized wave when selected.

Figure 11:
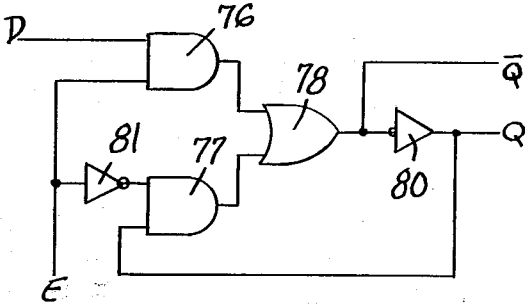
FIG. 11 is a schematic representation of a gating network of FIG. 7.

The gates 46 and 50 are preferably four-bit bi-stable latches identified as 74LS75 integrated circuit chips. With reference to FIG. 11, each latch comprises a pair of Nand gates 76 and 77 having outputs to an Or circuit 78. The output of the Or circuit 78 is passed to an inverter 80 which supplies on a output Q and also prior to an inverter 80 supplies a Q output. An enable signal E, as by the closing of switch 51, will be applied through an inverter 81 to gate 77. Data input D (N, E, W, or S) and the enable signal are both applied to all latches. When the enable signal goes low, the information (that was present at the data input at the time the transition occurred) is retained at the Q output.

When the enable switch 49 is initially closed, an enable signal is applied to each of the latches in gates 50. Thereafter, the individual latches of each gate will provide an output signal if a data signal D is received. The operation and connections of the gates is more fully explained in the TTL Data Book for Design Engineers, Texas Instruments, Inc., 2nd Edition, 1976, pp. 7–35.

Figure 12A:
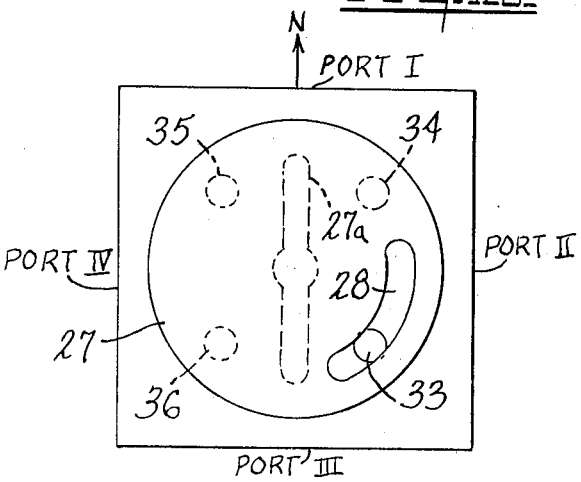
FIGS. 12*a* and 12*b* are a diagrammatic view of the operation of the direction sensing device in the antenna housing of FIG. 1.

Reference is now made to FIG. 12*a*. The antenna housing 12 is shown with the camera pointed North toward the receiving station. Then switch 49 is closed to apply an enabling signal to gates 50. In this orientation, phototransistor 33 detects light from emitter 31 and an N signal appears at line 41*a*. This is decoded as previously explained. A decoder signal turns off transistor 54. This applies a low signal to the diode 67 of the corresponding antenna switching network and the antenna of Port I on housing 12 is selected for transmission. All other legs of the antenna switching network are shorted to ground.

Figure 12B:
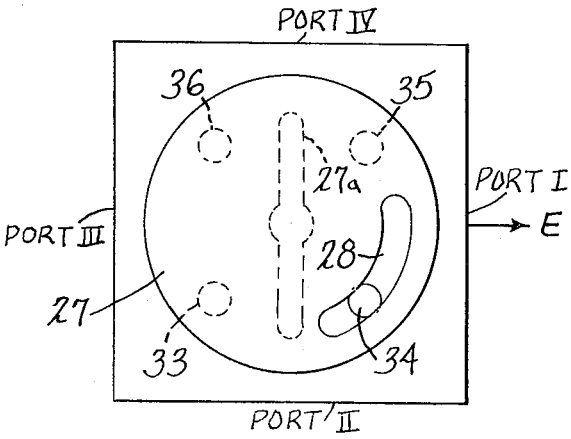

Assume now that the cameraman focuses on a subject as shown in FIG. 12*b*. Slot 28 in the compass disk will permit phototransistor 34 to receive light from emitter 29. This will produce an E signal on line 41*b* and resultant E output from decoder 47. Selector network of FIG. 9 will remove the ground from its corresponding switching leg of FIG. 9, and the Port IV antenna will be connected to the transmitter for transmission toward the receiving station.

As the camera may continue to turn through 360°, antennae Ports III, IV, and then again I, will be selected in response to the direction indicating means.

Figure 13:
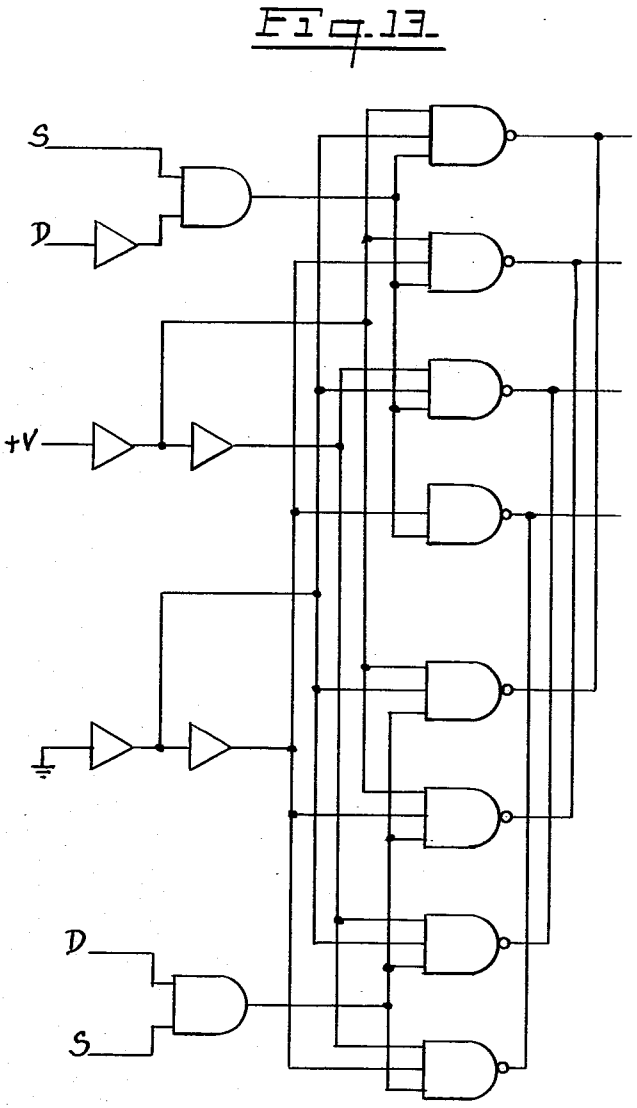
FIG. 13 is a schematic representation of a decoder of FIG. 7.

The decoders 47 and 48 are schematically represented in FIG. 13. These are 75LLS156 integrated circuit chips dual 2-line-to-4-line decoders, and comprise two sets of four Nand gates. A stored signal S (N, E, S, or W) from gates 50 is applied to each S input, together with a data signal D, is applied to Nand gates 80 and 81. Upon proper coincidence of a signal from gates 46, a N, E, S, or W signal will appear at the output of one of decoders 47 or 48. This circuit is more fully explained on pp. 7–175, 176 of the TTL Data Book for Design Engineers, Texas Instruments, Inc., 2nd Edition, 1976.

The reflectors 20–23 are of a thin metal or plastic material with copper clad surfaces positioned approximately 0.15 wave length behind the antenna defined on a parallel side wall of housing 12. The reflectors direct radiation of each antenna forwardly and provide isolation between the antenna. The reflectors extend between a board 82 (FIG. 1) and the top wall 19 of housing 12. Board 82 is supported from bottom wall 15 by spacers 83 and carries thereon the antenna switching network of FIG. 9. The RF input from transmitter 11 is coupled to antenna switching network input terminal 61 through a connector 84.

An antenna system embodying the invention may have six or more sides or antenna ports each oriented 60° from adjacent ports. Moreover, the side walls of the antenna housing may be tilted upwardly taking the slope of a trapezoid where the receiver is to be located at a higher elevation.

An antenna system embodying the invention, is light in weight and adds little, if any, burden to a video camera. An antenna of the system will always transmit in an angular sector directed toward a predetermined receiver location without the necessity of having to rotate and the accompanying rotative mechanism.

While the invention has been disclosed in conjunction with a video camera and transmitter, it may be used in other environments, for example with a hand-held or portable computer, for telemetry purposes.

It may thus be seen that the objects of the invention set forth as well as those made apparent are efficiently attained.

While a preferred embodiment of the invention has been set forth for purposes of disclosure, other embodiments of the invention as well as modification to the disclosed embodiment which do not depart from the scope of the invention, may occur to others skilled in the art. Accordingly, the appended claims are intended to cover all embodiments of the invention which do not depart from the spirit and scope of the invention.

What I claim is:

1. An antenna system comprising a plurality of angular displaced antenna, each adapted to be coupled to a portable transmitter, said antenna system being in fixed relation to the transmitter, direction sensing means, means responsive to said direction sensing means for directionally orienting said antenna system toward a predetermined location, antenna selection means, and means responsive to said direction sensing means and said means for orienting, for actuating said selection means to couple the antenna closest directionally oriented toward the predetermined location to the transmitter.

2. The system of claim 1 further including a housing member having a multiplicity of equiangularly disposed surfaces, an antenna on each of said surfaces, and means for coupling the transmitter to only one of said antenna.

3. The system of claim 1 further including means for indicating the selected antenna.

4. The system of claim 2 further including an electrically reflective surface disposed one quarter wavelength behind each antenna in said housing.

5. The system of claim 2, where each antenna is defined on one of said surfaces to propogate a circularly polarized wave.

6. The system of claim 1, where said direction sensing means comprises a multiplicity of pairs of equiangular disposed light emitters and light sensitive devices, one of said devices arranged to be exposed to its associated emitter dependent upon the directional orientation of the antenna system.

7. The system of claim 6, where said emitters and said devices are mounted on either side of a compass card, and an arcuate slot is defined in said compass card to expose a device to its associated emitter.

8. The system of claim 7 where said slot is arcuate and spans an angle less than the angle between said emitters and said devices.

9. The system of claim 1 wherein the number of antenna is an even number.

10. An antenna system for a portable transmitter comprising a housing member having a multiplicity of side walls equiangularly disposed about a vertical axis, an antenna on each wall arranged to transmit a signal in a predetermined angular sector of the compass, a portable transmitter in fixed relation to said housing, means for orienting said antenna system toward a predetermined location, selection means for selectively coupling said transmitter to one of said antenna, direction sensing means in said housing, and means responsive to said direction sensing means and said orienting means for causing said selection means to couple the antenna closest directionally oriented toward the predetermined location to said transmitter.

11. The system of claim 1 mounted to a portable video camera, wherein said orienting means comprises manual means for selecting an antenna when the camera is aimed at a predetermined location, logic means responsive to said manual means and said direction sensing means for coupling the antenna closest oriented toward the receiving location to said transmitter, said logic means being further effective in response to said direction sensing means to selectively couple the antenna closest directionally oriented to the receiving location to said transmitter as the angular position of the camera is varied.

12. The system of claim 10 where said means for selecting disables all antenna except the antenna directionally oriented toward the receiving location.

13. The system of claim 10 further including means for indicating the selected antenna.

14. The system of claim 10 further including an electrically reflective surface disposed 0.15 wave-length behind each antenna in said housing.

15. The system of claim 10, where each antenna is defined on one of said surfaces to propogate a circularly polarized wave.

16. The system of claim 10 where said direction sensing means comprises a multiplicity of pairs of equiangular disposed light emitters and light sensitive devices, one of said devices arranged to be exposed to its associated emitter dependent upon the directional orientation of the transmitter.

17. The system of claim 16 where said emitters and said devices are mounted on either side of a compass card, and a slot is defined in said compass card to expose a device to its associated emitter.

18. The system of claim 17 where said slot is arcuate and spans an angle less than the angle between said emitters and said devices.

19. The system of claims 5 or 15, where each antenna is in the form of a double dipole.

20. The system of claims 4 or 14, where said reflective surfaces are positioned 0.15 to 0.25 wavelength behind each antenna.

21. An antenna system comprising a polygonal housing member having surfaces equiangularly disposed about a common axis, an antenna on each of said surfaces, a portable radio frequency transmitter, said housing being in fixed relation to said transmitter, a member having a plurality of reflective surfaces disposed in said housing equal in number to said housing member surfaces and substantially parallel thereto, direction sensing means in said housing, and means responsive to said direction sensing means for selectively coupling said transmitter to one of said antenna to transmit toward a predetermined location regardless of the angular orientation of said transmitter.

22. The antenna system of claim 21 further including means for indicating the selected antenna.

23. The antenna system of claim 21, where said surfaces are angled upwardly and are trapezoidal in outline.

24. The antenna system of claim 21, where each antenna is arranged to propogate a circularly polarized wave.

25. The antenna system of claim 21, where said reflective surfaces are 0.15 to 0.25 wavelength behind each antenna.

26. The antenna system of claim 24, where each antenna is a double dipole.

* * * * *